US008699916B2

(12) United States Patent
Ohnishi

(10) Patent No.: US 8,699,916 B2
(45) Date of Patent: Apr. 15, 2014

(54) PROCESSING STRUCTURAL MEMBER AND IMAGE FORMING APPARATUS

(75) Inventor: Yuzo Ohnishi, Osaka (JP)

(73) Assignee: Kyocera Document Solutions Inc. (JP)

( * ) Notice: Subject to any disclaimer, the term of this patent is extended or adjusted under 35 U.S.C. 154(b) by 142 days.

(21) Appl. No.: 13/534,420

(22) Filed: Jun. 27, 2012

(65) Prior Publication Data

US 2013/0004203 A1 Jan. 3, 2013

(30) Foreign Application Priority Data

Jun. 30, 2011 (JP) ..... 2011-145944

(51) Int. Cl.
*G03G 21/18* (2006.01)
*G03G 15/20* (2006.01)

(52) U.S. Cl.
CPC ..... *G03G 15/2071* (2013.01)
USPC ..... 399/114; 399/110; 399/122; 361/679.58

(58) Field of Classification Search
CPC ..... G03G 15/2071; G03G 2221/16; G03G 2221/1639; G03G 2221/1846; G03G 2221/1884
USPC ..... 399/110, 114, 122; 361/679.58
See application file for complete search history.

(56) References Cited

U.S. PATENT DOCUMENTS

| | | | | |
|---|---|---|---|---|
| 5,579,098 | A | 11/1996 | Noguchi et al. | |
| 5,819,139 | A * | 10/1998 | Harlan et al. | 399/110 |
| 7,720,415 | B2 * | 5/2010 | Murano | 399/122 |
| 8,190,070 | B2 * | 5/2012 | Maeshima et al. | 399/262 |
| 8,306,457 | B2 * | 11/2012 | Saiki et al. | 399/122 |

FOREIGN PATENT DOCUMENTS

| | | |
|---|---|---|
| JP | 3-80460 | 8/1991 |
| JP | 7-210023 | 8/1995 |
| JP | 2000-356938 | 12/2000 |
| JP | 2009053563 A * | 3/2009 |

* cited by examiner

*Primary Examiner* — Ryan Walsh
(74) *Attorney, Agent, or Firm* — Gerald E. Hespos; Michael J. Porco; Matthew T. Hespos

(57) ABSTRACT

A processing structural member has a processing housing for supporting a processing portion, a locking lever, a cover and a holding portion. The locking lever changes the posture thereof between a locking posture of locking the position of the processing housing, and a releasing posture of releasing the locking. The cover is mounted on the processing housing to be pivotally movable between a covering position of covering the locking lever, and an opening position of exposing the locking lever to be visually recognizable. The holding portion is mounted on the processing housing to be pivotally movable with the cover. The cover has an interference member which is inoperable to interfere with the locking lever in the locking posture and is operable to interfere with the locking lever in the releasing posture in shifting the cover from the opening position to the covering position.

12 Claims, 12 Drawing Sheets

PROCESSING STRUCTURAL MEMBER AND IMAGE FORMING APPARATUS

This application is based on Japanese Patent Application No. 2011-145944 filed on Jun. 30, 2011, the contents of which are hereby incorporated by reference.

BACKGROUND

The present disclosure relates to a processing structural member for performing a predetermined processing, and an image forming apparatus provided with a fixing device for fixing toner on a sheet.

A number of machines and equipment are configured in such a manner that parts or a part of the equipment are detachable for maintenance service or repair. For instance, there is known an image forming apparatus such as a copier, a printer or a facsimile machine, as an example of such machines and equipment.

An image forming apparatus is provided with a fixing device for fusing toner and fixing the toner on a sheet. There is known a fixing device (a conventional device 1) provided with a locking mechanism for locking the position of the fixing device in a housing body of the image forming apparatus. A user is allowed to release the locking of the fixing device by manipulating the locking mechanism, and detach the fixing device to the outside from the housing body.

As described above, the fixing device generates heat for fusing toner. There is also known a fixing device (a conventional device 2) having a color changeable portion whose color is changed depending on the heat of the fixing device for safety measures for the user. Since the user is allowed to visually recognize a temperature of the fixing device by way of the color changeable portion, the user is allowed to perform a replacement operation relatively safely.

Generally, it is not desirable to perform an unnecessary operation to machines and equipment. For instance, in the case where the locking mechanism of the conventional device 1 is unnecessarily or unintentionally operated, the locking of the fixing device at a predetermined position may be released, and the fixing device may be moved against the user's intention. This may impair the function of the fixing device which is expected to be performed. The technology of the conventional device 2 allows the user to perceive the heat by way of a change in the color. However, in the case where the user is not aware of a color change of the color changeable portion, or in the case where the user does not understand what the color change stands for, the effect to be expected by the technology of the conventional device 2 is hardly obtained.

Further, there is another task to be achieved i.e. a task of letting the user recognize that the fixing device is not completely mounted at a predetermined position in a housing body.

In view of the above, an object of the present disclosure is to provide a processing structural member and an image forming apparatus that enable a user to easily recognize incomplete mounting of a processing housing, while preventing the user from performing an unnecessary operation.

SUMMARY

A processing structural member according to an aspect of the present disclosure includes a processing housing which supports a processing portion for performing a predetermined processing, a locking lever, a cover, and a holding portion. The locking lever is operable to change a posture thereof between a locking posture of locking a position of the processing housing, and a releasing posture of releasing the locking. The cover is mounted on the processing housing to be pivotally movable between a covering position of covering the locking lever, and an opening position of exposing the locking lever to be visually recognizable. The holding portion is mounted on the processing housing to be pivotally movable with the cover. The cover has an interference member which is inoperable to interfere with the locking lever when the locking lever is in the locking posture, and is operable to interfere with the locking lever when the locking lever is in the releasing posture in shifting the cover from the opening position to the covering position.

An image forming apparatus according to another aspect of the present disclosure includes a housing body, an image forming portion which forms an image on a sheet using toner, a fixing portion which fixes the toner on the sheet, and a fixing housing which supports the fixing portion. The image forming apparatus further includes a locking lever which is operable to change a posture thereof between a locking posture of locking a position of the fixing housing in the housing body, and a releasing posture of releasing the locking; a cover which is mounted on the fixing housing to be pivotally movable between a covering position of covering the locking lever, and an opening position of exposing the locking lever to be visually recognizable; and a holding portion which is mounted on the fixing housing to be pivotally movable with the cover. The cover has an interference member which is inoperable to interfere with the locking lever when the locking lever is in the locking posture, and is operable to interfere with the locking lever when the locking lever is in the releasing posture in shifting the cover from the opening position to the covering position.

These and other objects, features and advantages of the present disclosure will become more apparent upon reading the following detailed description along with the accompanying drawings.

DETAILED DESCRIPTION

Figure 1:
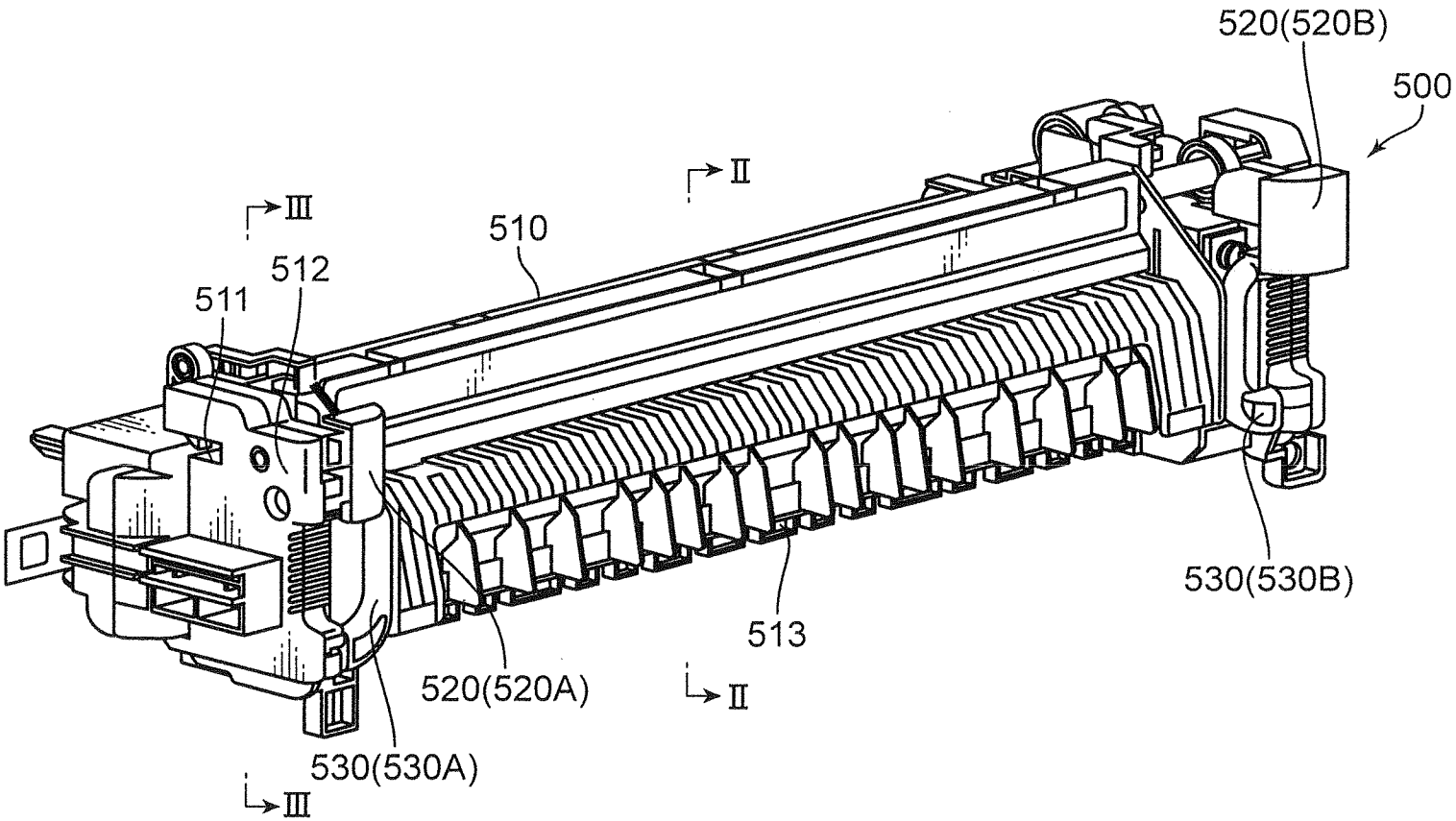
FIG. 1 is a perspective view of a fixing device embodying a processing structural member of the present disclosure.

In the following, an embodiment of the present disclosure is described referring to the drawings. The terms such as "up", "down", "left", and "right" which indicate the directions are used in the following description for clarifying the description, and do not limit the present disclosure. Further, the term "sheet" which will be used in the following description indicates any sheet material, such as a copy sheet, tracing paper, a cardboard, an OHP sheet, other sheet on which an image is formed, or a sheet to which a specified treatment is applied. The term "processing" which will be used in the following description indicates any processing capable of changing a physical property or a material property by applying a certain treatment to a sheet material.

FIG. 1 is a perspective view of a processing structural member embodying the present disclosure. The processing structural member as exemplified in FIG. 1 is a fixing device 500 to be used in an image forming apparatus such as a copier, a printer or a facsimile machine. The fixing device 500 performs a fixing processing of fusing toner and fixing the toner on a sheet. In other embodiment, any device capable of performing a processing other than the fixing processing may be used as the processing structural member.

The fixing device 500 is provided with a fixing housing 510. For instance, a roller pair for holding and transporting a sheet, a heater for applying thermal energy to the roller pair, a wiring for supplying electric power to the heater, and other devices required for performing a fixing processing are housed and supported in the fixing housing 510. In the embodiment, a processing housing is described as the fixing housing 510. In other embodiment using a processing structural member for performing a predetermined processing other than the fixing processing, devices required for performing an intended processing by the processing structural member may be housed and supported in the processing housing.

A side plate 512 of the fixing housing 510 is formed with a horizontally extending slit 511. A support plate for supporting the fixing housing 510 is mounted in the slit 511. In the embodiment, an inner wall of a housing body 2 (see FIG. 10) of an image forming apparatus 1 is preferably used as the support plate. In the embodiment, a support plate 600 is an example of the support plate (see FIG. 3).

The fixing housing 510 is provided with a cover 520 having a prismatic shape with a substantially fan-like shape in plan view, and a substantially C-shaped rod-like holding portion 530 which is formed integrally with the cover 520 and extends downwardly from the cover 520. The cover 520 is a member which is disposed to cover a locking lever 550, which will be described later. The holding portion 530 is a member to be held by a user when the user detaches the fixing device 500 from the housing body 2. The holding portion 530 is pivotally mounted on the fixing housing 510.

The user is allowed to hold the holding portion 530, and pivotally move the holding portion 530 and the cover 520 altogether between a covering position (a position for covering an operation portion 554 of the locking lever 550) at which the holding portion 530 is set flush with a front plate 513 of the fixing housing 510, and an opening position (a position at which the operation portion 554 of the locking lever 550 is exposed so that the user can visually recognize the locking lever 550) at which the holding portion 530 projects forwardly with respect to the front plate 513. In the embodiment, when the user shifts the holding portion 530 and the cover 520 to the opening position, the user is allowed to hold the holding portion 530, and exert a force on the fixing device 500 in such a direction that the fixing housing 510 is movable along the slit 511.

Figure 2:
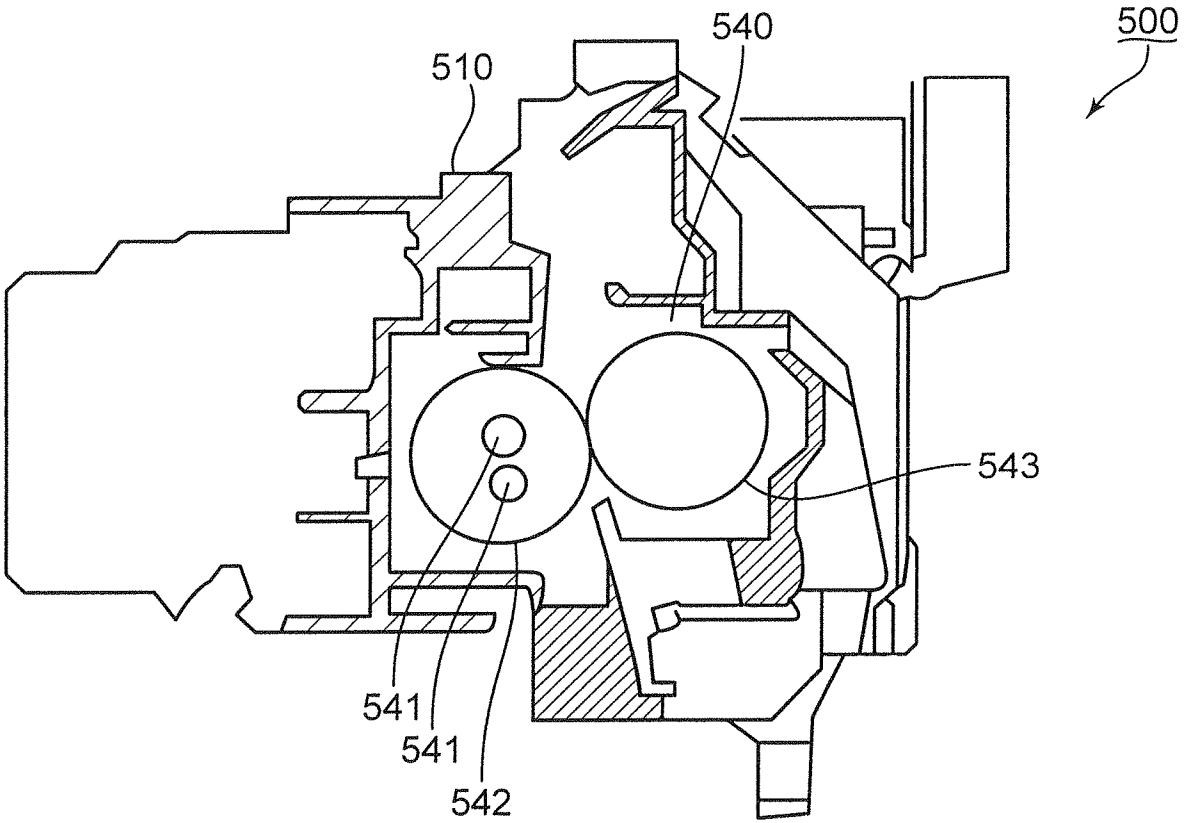
FIG. 2 is a schematic sectional view taken along the line II-II in FIG. 1.

FIG. 2 is a schematic sectional view taken along the line II-II in FIG. 1. The fixing device 500 includes a fixing portion 540 serving as a processing portion. The fixing portion 540 performs a processing of fixing toner on a sheet by applying a pressure to the sheet while fusing the toner. The fixing portion 540 includes a heating roller 542 internally provided with a heater 541, and a pressing roller 543 to be pressingly contacted with the heating roller 542. A sheet carrying toner thereon is allowed to pass a fixing nip portion between the heating roller 542 and the pressing roller 543, whereby the sheet is heated and pressed, and the toner is fixed onto the sheet.

The fixing housing 510 supports the fixing portion 540, in other words, supports the heating roller 542 and the pressing roller 543. When the fixing device 500 is operated, the fixing housing 510 is brought to a relatively high temperature state by radiation of heat or transfer of heat from the heating roller 542.

Figure 3:
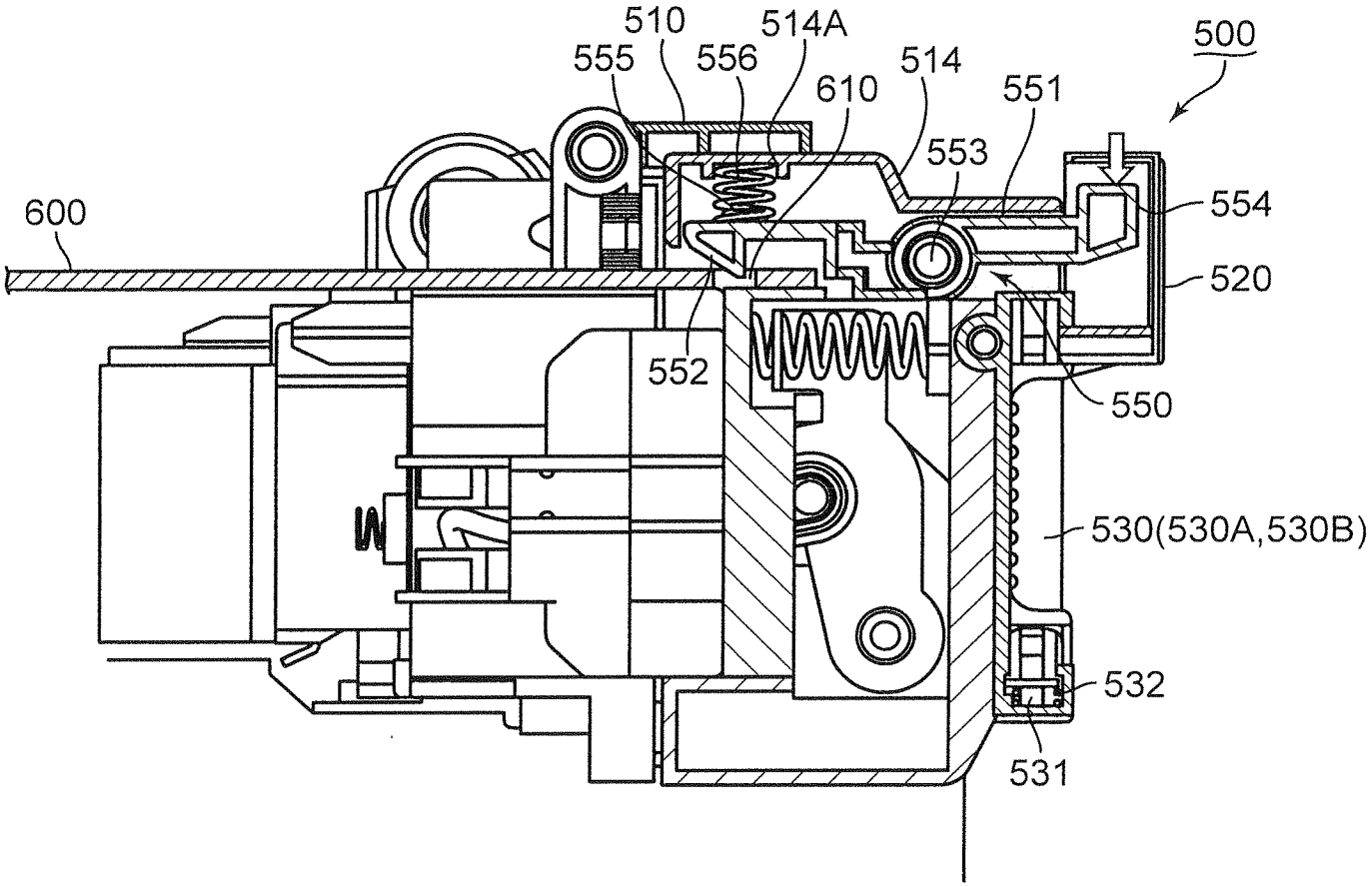
FIG. 3 is a schematic sectional view taken along the line III-III in FIG. 1, specifically, a diagram showing a state that a locking lever is in a locking posture.

FIG. 3 is a schematic sectional view taken along the line III-III in FIG. 1. The fixing device 500 is housed in the housing body 2 of the image forming apparatus 1. The housing body is internally provided with the support plate 600 as a plate frame. The support plate 600 serves as a support portion for stably supporting the fixing device 500. The slit 511 formed in the side plate 512 of the fixing housing 510 is fitted to the support plate 600 to install. The support plate 600 is formed with an engagement hole 610 (an engagement portion) for locking the position of the fixing device 500.

The fixing device 500 includes the locking lever 550 for locking the position of the fixing housing 510 with respect to the support plate 600 (housing body 2). The locking lever 550 is a member which is operable to change the posture of the fixing housing 510 between a locking posture (see FIG. 3) where the position of the fixing housing 510 is locked with respect to the housing body 2 by engagement in an engagement hole 610, and a releasing posture (see FIG. 4) where the locking is released.

The locking lever 550 is a generally rod-shaped member, and has a first end and a second end opposite to the first end. More specifically, the locking lever 550 includes an arm 551 formed into a substantially prismatic shape, a hook 552 (a hook portion) having a substantially triangular prismatic shape and projecting from a lower surface of a distal end of the first end of the arm 551, a pivot shaft 553 (a pivot shaft) provided substantially at an axially middle position of the arm 551, and the operation portion 554 formed at the second end of the arm 551.

Figure 4:
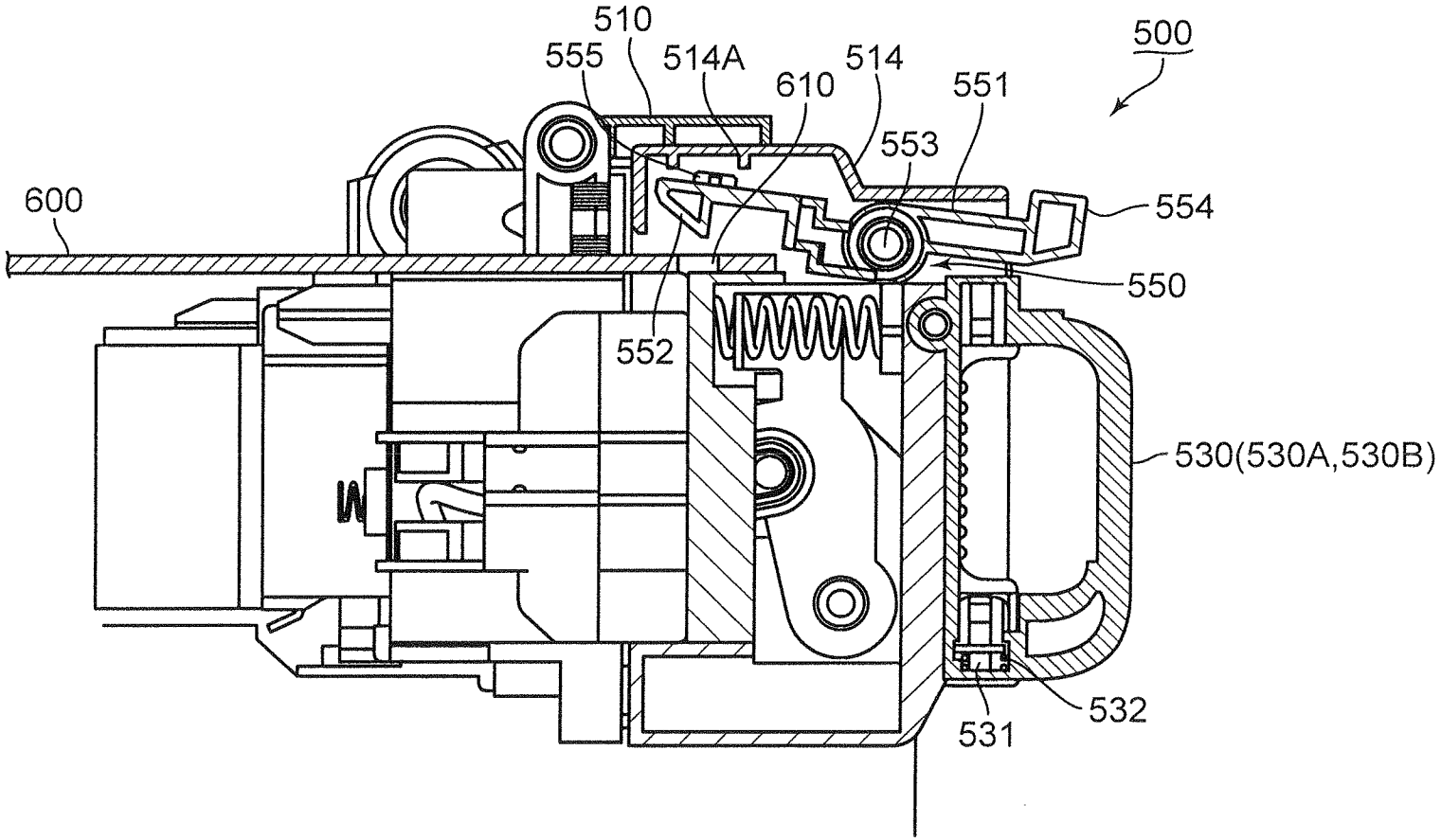
FIG. 4 is a diagram showing a state that the posture of the locking lever is changed from the state shown in FIG. 3 to a releasing posture.

The hook 552 is engaged in the engagement hole 610 of the support plate 600 when the fixing housing 510 is in the locking posture shown in FIG. 3, whereby the fixing housing 510 is locked on the support plate 600. The pivot shaft 553 supports the arm 551 to be pivotally movable with respect to the fixing housing 510. The arm 551 is pivotally movable about an axis of the pivot shaft 553. A cross-shaped projection 555 is formed on a top surface of the hook 552, and a spring holder 514A is provided at a lower surface of a top plate of a housing portion 514, at a position corresponding to the cross-shaped projection 555. A coil spring 556 is interposed between the cross-shaped projection 555 and the spring holder 514A. A lower end of the coil spring 556 is received in the cross-shaped projection 555, and an upper end of the coil spring 556 is received in the spring holder 514A. With the provision of the coil spring 556, the arm 551 is constantly urged in such a direction that the hook 552 is engaged in the engagement hole 610. In FIG. 4, the illustration of the coil spring 556 is omitted.

The operation portion 554 is a member to be pressed by the fingertip of a user when the user changes the posture of the locking lever 550. The operation portion 554 has a substantially rectangular parallelepiped shape. Specifically, the operation portion 554 is used for releasing the locking of the fixing housing 510 from the support plate 600 by the locking lever 550. The locking lever 550 has a home position when the fixing housing 510 is in the locking posture shown in FIG. 3 by an urging force of the coil spring 556. When the user presses the operation portion 554 downwardly, the arm 551 is pivotally moved about the axis of the pivot shaft 553 clockwise in FIG. 3 against the urging force of the coil spring 556. As a result of the above operation, as shown in FIG. 4, the hook 552 is moved upwardly, and the posture of the locking lever 550 is changed to the releasing posture where the engagement of the hook 552 in the engagement hole 610 is released.

Figure 5:
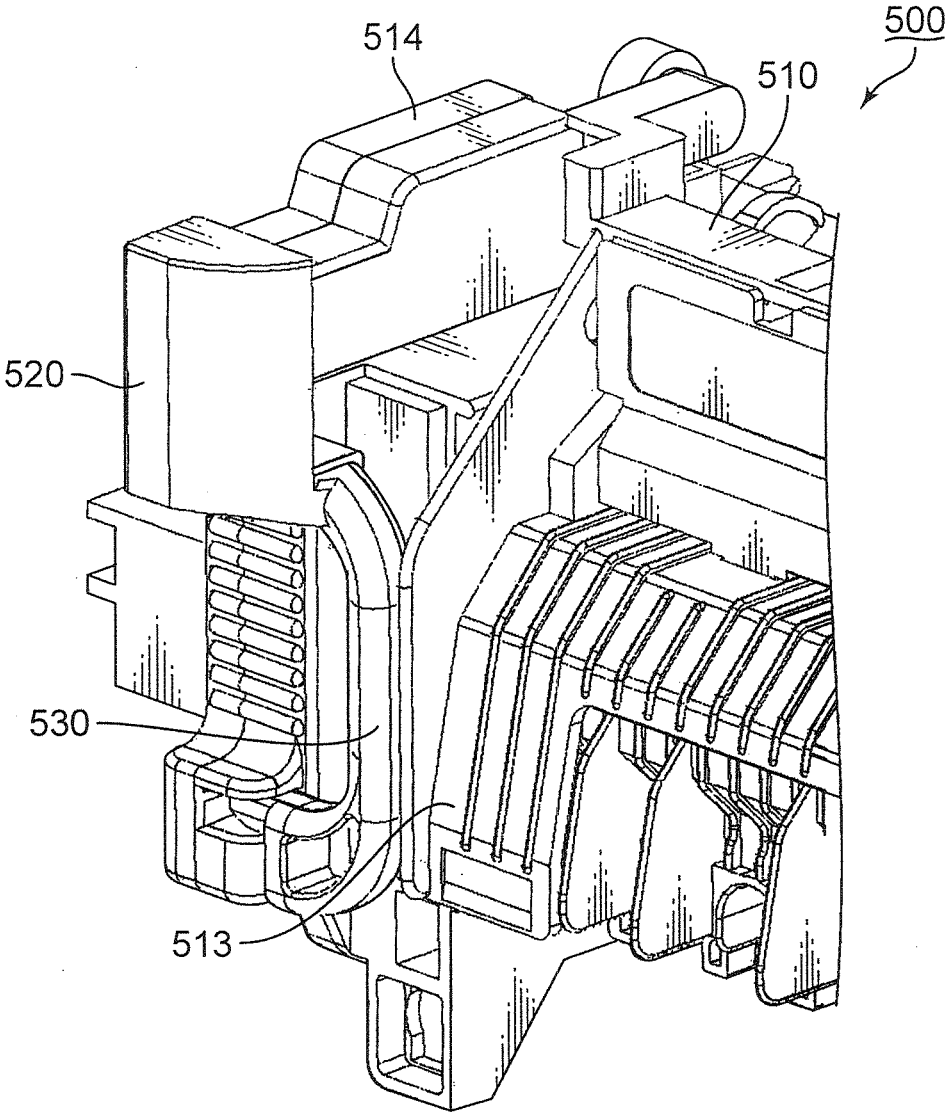
FIG. 5 is an enlarged perspective view of peripheral portions of a cover and a holding portion of the fixing device, specifically, a diagram showing a state that the cover is in a covering position.
Figure 6:
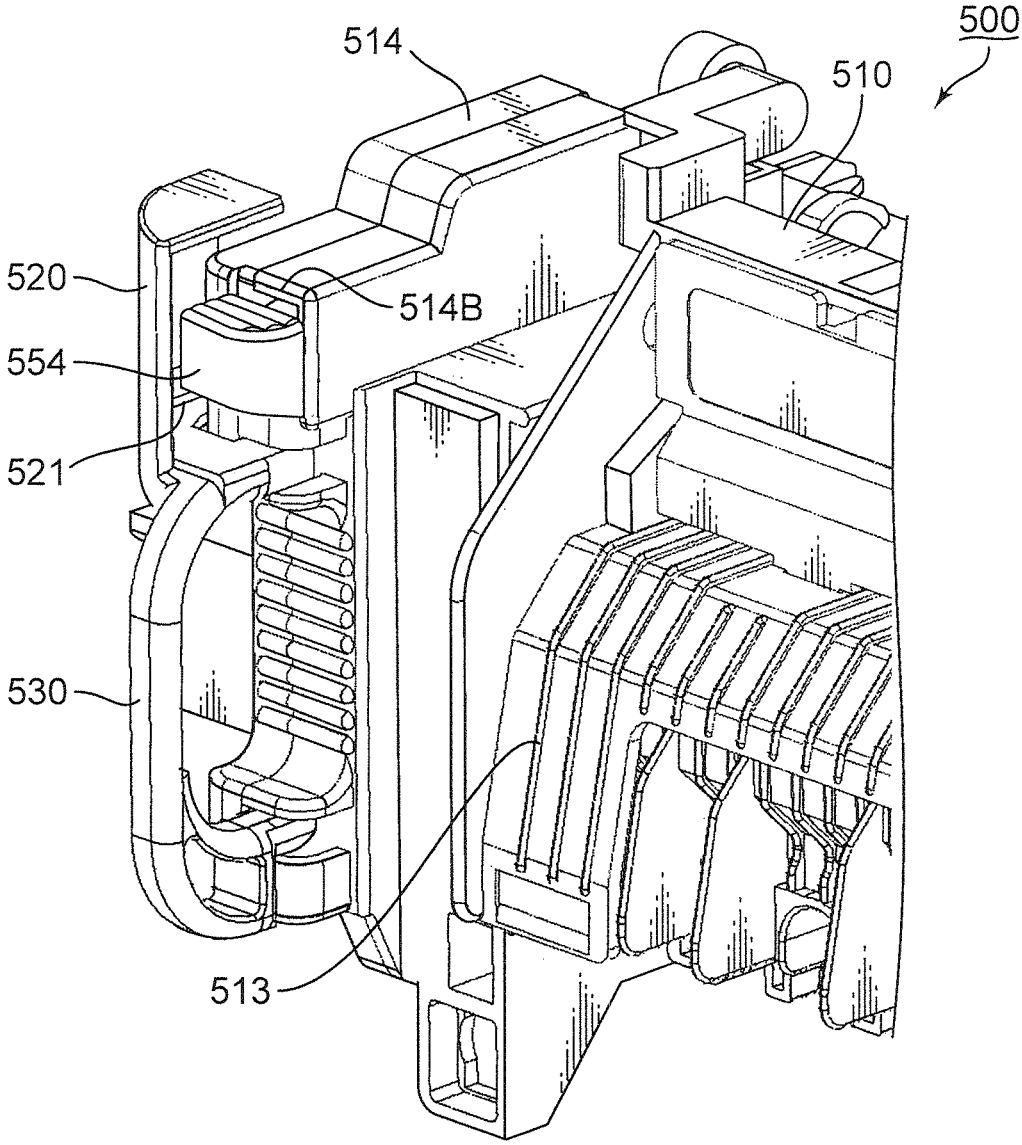
FIG. 6 is an enlarged perspective view of peripheral portions of the cover and the holding portion of the fixing device, specifically, a diagram showing a state that the cover is in an opening position.

FIG. 5 is an enlarged perspective view of the fixing device 500 showing a structure of peripheral portions of the cover 520 and the holding portion 530, specifically, a diagram showing a state that the cover 520 is in the covering position. FIG. 6 is a diagram showing a state that the cover 520 is in the opening position. The fixing housing 510 includes the housing portion 514 for housing the locking lever 550 therein. The locking lever 550 is housed in the housing portion 514 in such a manner that the operation portion 554 projects from an opening end surface 514B (see FIG. 6) of the housing portion 514.

The cover 520 is a member to be mounted on the fixing housing 510 in such a state that the cover 520 is pivotally movable between the covering position where the cover 520 covers the operation portion 554 projecting from the opening end surface 514B of the housing portion 514, in other words, covers the locking lever 550, and the opening position where the operation portion 554 is exposed to be visually recognizable by the user. The cover 520 is made of a non-transparent resin, preferably, a resin whose color is the same as the color of the fixing housing 510. With this arrangement, the cover 520 is operable to cover the operation portion 554 in a visually unrecognizable state. In other embodiment, a cover 520 made of a transparent resin may be formed to surround the operation portion 554. With such a structure, it is also possible to prevent the user from inadvertently touching the operation portion 554. When the cover 520 is in the covering position, the holding portion 530 is set flush with the front plate 513 of the fixing housing 510.

The user is allowed to change the position of the cover 520 to the opening position by holding the holding portion 530 and pivotally moving the holding portion 530 in a direction toward the user. When the holding portion 530 is rotated by about 90 degrees, the holding portion 530 projects from the front plate 513 of the fixing housing 510. The cover 520 is rotated together with the holding portion 530. With this arrangement, the operation portion 554 projecting from the opening end surface 514B of the housing portion 514 is exposed to be visually recognizable by the user.

With the above arrangement, when the cover 520 is in the covering position, the holding portion 530 is set flush with the fixing housing 510. This prevents the user from inadvertently touching the holding portion 530. On the other hand, when the cover 520 is in the opening position, the holding portion 530 projects from the fixing housing 510. This allows the user to relatively easily exert a force on the fixing housing 510.

In the embodiment, to simplify the description, the cover 520 located on the left side in FIG. 1 is called as a first cover 520A, and the cover 520 located on the right side in FIG. 1 is called as a second cover 520B. Likewise, the holding portion 530 located on the left side in FIG. 1 is called as a first holding portion 530A, and the holding portion 530 located on the right side in FIG. 1 is called as a second holding portion 530B. The operation portion 554 to be covered and exposed by the first cover 520A is called as a first operation portion, and the operation portion 554 to be covered and exposed by the second cover 520B is called as a second operation portion. The locking cover 550 including the first operation portion is called as a first locking lever, and the locking cover 550 including the second operation portion is called as a second locking lever.

As shown in FIG. 1, when the first cover 520A and the second cover 520B are in the covering position, the first cover 520A and the second cover 520B respectively cover the first operation portion and the second operation portion in such a manner that the first operation portion and the second operation portion are visually unrecognizable by the user. This prevents the user from perceiving the first operation portion and the second operation portion. Thus, this arrangement prevents the user from inadvertently manipulating the first operation portion and the second operation portion. Further, since the first cover 520A and the second cover 520B physically cover the first operation portion and the second operation portion, respectively, there is no likelihood that the user may inadvertently touch the operation portion 554 and manipulate the operation portion 554.

When the user holds the first holding portion 530A and the second holding portion 530B and pivotally moves the fixing housing 510, the first cover 520A and the second cover 520B are pivotally moved toward the opening position together with the first holding portion 530A and the second holding portion 530B. As a result of this operation, the user can visually recognize the first operation portion and the second operation portion.

As shown in FIG. 3, a torsion coil spring 532 (an urging member) is inserted to the pivot shaft 531 of each of the first holding portion 530A and the second holding portion 530B. The torsion coil springs 532 urge the first holding portion 530A and the second holding portion 530B in such a direction that the cover 520 is shifted from the opening position toward the covering position. In other words, unless otherwise the user intentionally manipulates the first holding portion 530A and the second holding portion 530B for shifting the first cover 520A and the second cover 520B toward the opening position, the first cover 520A and the second cover 520B keep covering the locking lever 550. This arrangement is advantageous in preventing the user from inadvertently touching the operation portion.

With this arrangement, when the user shifts the first cover 520A and the second cover 520B to the opening position, the user is forced to press the operation portion 554 downwardly by e.g. his or her thumb, while holding the first holding portion 530A and the second holding portion 530B. In other words, the user is prompted to manipulate the operation portion 554, without touching the fixing housing 510. Thus, the structure according to the embodiment is advantageous in prompting the user to safely perform an operation such as maintenance service or repair.

When the user presses the operation portion 554 downwardly, the engagement between the hook 552 and the engagement hole 610 is released, and the locking of the fixing housing 510 at a predetermined position is released. Thereafter, the fixing housing 510 is movable relative to the support plate 600 by allowing the user to hold the first holding portion 530A and the second holding portion 530B and lift the first holding portion 530A and the second holding portion 530B toward the user. In other words, the user is allowed to detach the fixing device 500 from the housing body 2.

On the other hand, in the case where the fixing device 500 is mounted in the housing body 2, the user is allowed to mount the fixing housing 510 in the housing body 2 while holding the first holding portion 530A and the second housing portion 530B. When the fixing housing 510 is mounted at a predetermined position, and the hook 552 of the locking lever 550 reaches the position corresponding to the engagement hole 610 in the support plate 600, the hook 552 is engaged in the engagement hole 610 by the urging force of the coil spring 556. Thereby, the fixing housing 510 is brought to a locked state with respect to the housing body 2. When the user releases his or her hand from the first holding portion 530A and the second holding portion 530B in the above state, the first cover 520A and the second cover 520B, and the first holding portion 530A and the second holding portion 530B are returned to the covering position by the urging force of the torsion coil springs 532.

In the aforementioned arrangement, the user may misjudge that the mounting operation of the fixing housing 510 has been completed, regardless of the fact (an incomplete mounted state) that the fixing housing 510 is not mounted at the predetermined position and accordingly the hook 552 is not engaged in the engagement hole 610. In such a case, the fixing device 500, and accordingly the image forming apparatus 1 is rendered inoperable.

In order to avoid the aforementioned drawback, in this embodiment, a rib 521 (an interference member) is formed on the back surface of the cover 520, as shown in FIG. 6. The rib 521 is formed at such a position that the cover 520 is inoperable to interfere with the locking lever 550 (the operation portion 554) in the locking posture but is operable to interfere with the locking lever 550 in the releasing posture in shifting the cover 520 from the opening position to the covering position. With the formation of the rib 521 as described above, as far as the locking lever 550 is not brought to the locking posture, the cover 520 is restricted from returning to the covering position because of the interference between the locking lever 550 and the rib 521. This allows the user to promptly recognize that the fixing housing 510 is not locked with respect to the housing body 2.

Figure 7:
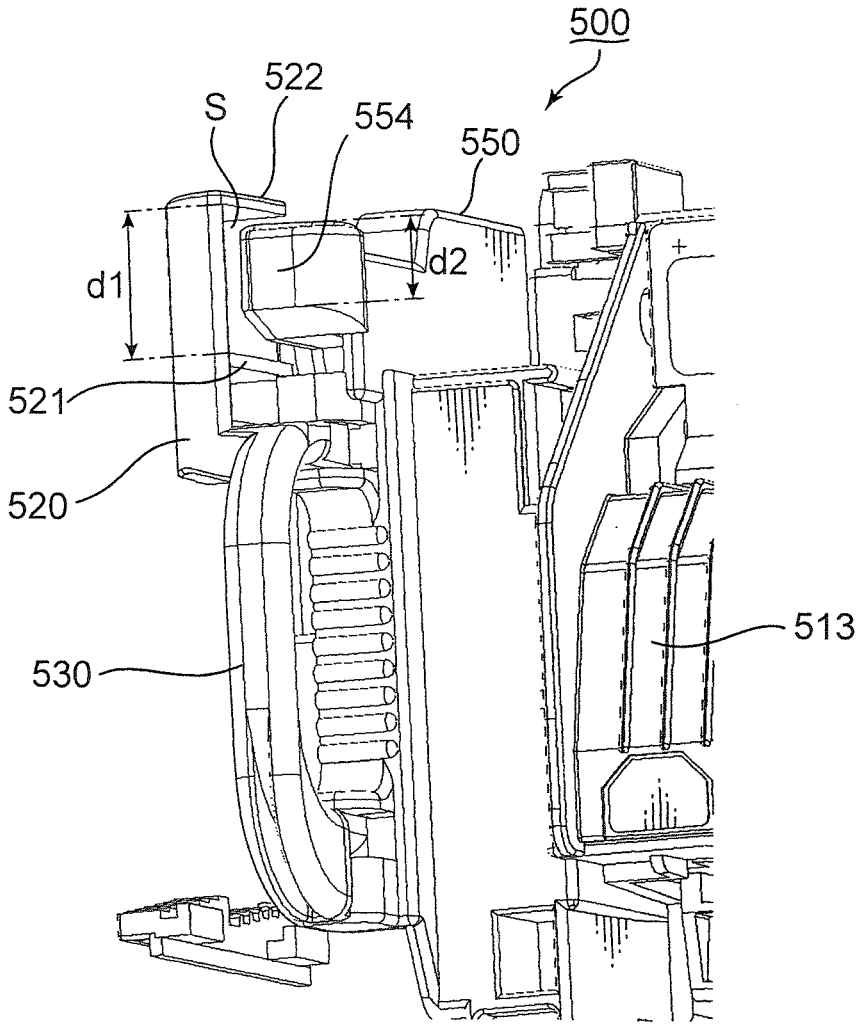
FIG. 7 is a perspective view showing a positional relation between a rib of the cover and an operation portion of the locking lever.

The rib 521 will be described in further detail. FIG. 7 is a perspective view showing a positional relation between the rib 521 of the cover 520 and the locking lever 550. FIG. 7 shows that the locking lever 550 is in a locking posture, in other words, is in a horizontal posture as shown in FIG. 3. The cover 520 has an arc-shaped curved surface with a certain length in up and down directions and a fan-like shape in plan view. The cover 520 is internally formed with a hollow portion extending in up and down directions. The rib 521 is a flat plate extending in a horizontal direction in the hollow portion, and divides an accommodation space S in such a manner that the operation portion 554 of the locking lever 550 is accommodated.

The accommodation space S faces forwardly with respect to the operation portion 554 of the locking lever 550 in the locking posture. The length of the accommodation space S in up and down directions, in other words, a distance d1 between a top plate 522 of the cover 520 and the rib 521 is set longer than a length d2 of the substantially rectangular parallelepiped-shaped operation portion 554 in up and down directions by a predetermined length. With this arrangement, when the locking lever 550 is in the locking posture, in other words, when the fixing housing 510 is mounted at a predetermined position, the operation portion 554 is operable to be received in the accommodation space S, without interference between the rib 521 and the operation portion 554. Thereby, it is possible to pivotally move and return the cover 520 from the opening position shown in FIG. 7 to the covering position shown in FIG. 5.

Figure 8:
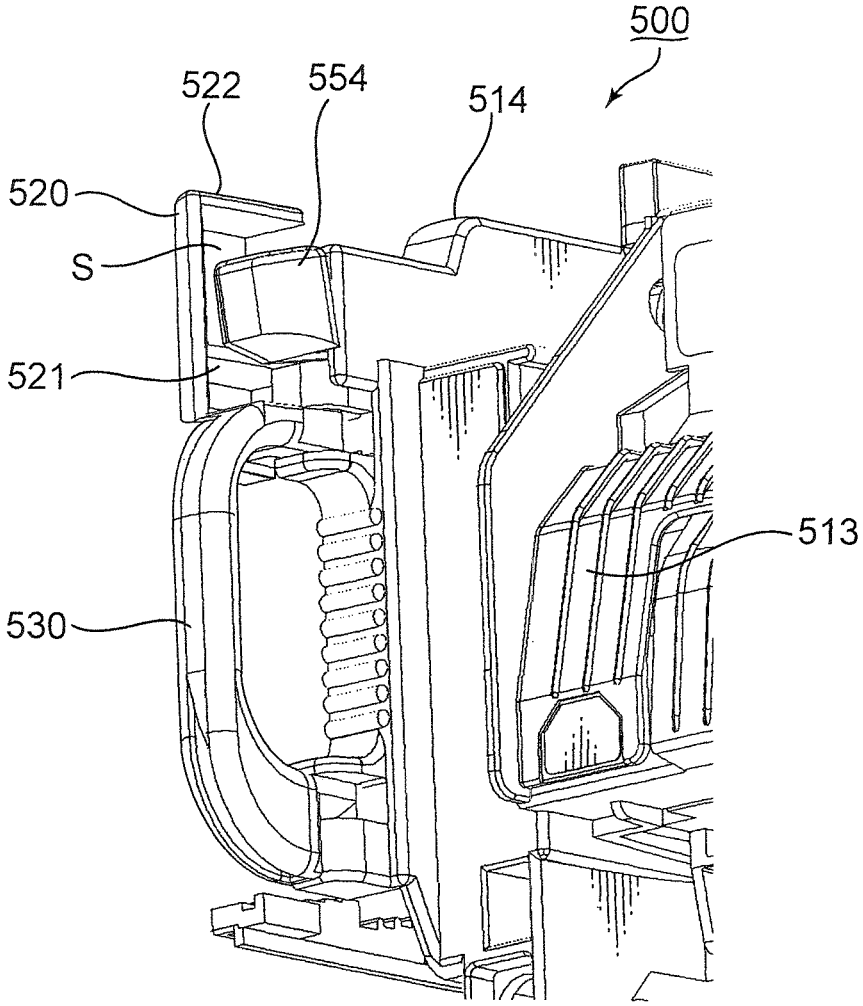
FIG. 8 is a perspective view showing a positional relation between the rib of the cover and the operation portion of the locking lever.

On the other hand, as shown in FIG. 8, when the locking lever 550 is kept in the releasing posture, the rib 521 interferes with the lower end of the operation portion 554. As shown in FIG. 4, the locking lever 550 in the releasing posture is pivotally movable about the axis of the pivot shaft 553, and is brought to such a tilt posture that the operation portion 554 of the locking lever 550 is lowered. Thus, the operation portion 554 is shifted downwardly with respect to the accommodation space S, and does not face forwardly with respect to the accommodation space S. As a result of the above operation, the operation portion 554 is located on a trajectory of the rib 521, and the operation portion 554 interferes with the rib 521. This obstructs a pivotal movement of the cover 520, and prevents the cover 520 from returning from the opening position to the covering position.

Figure 9:
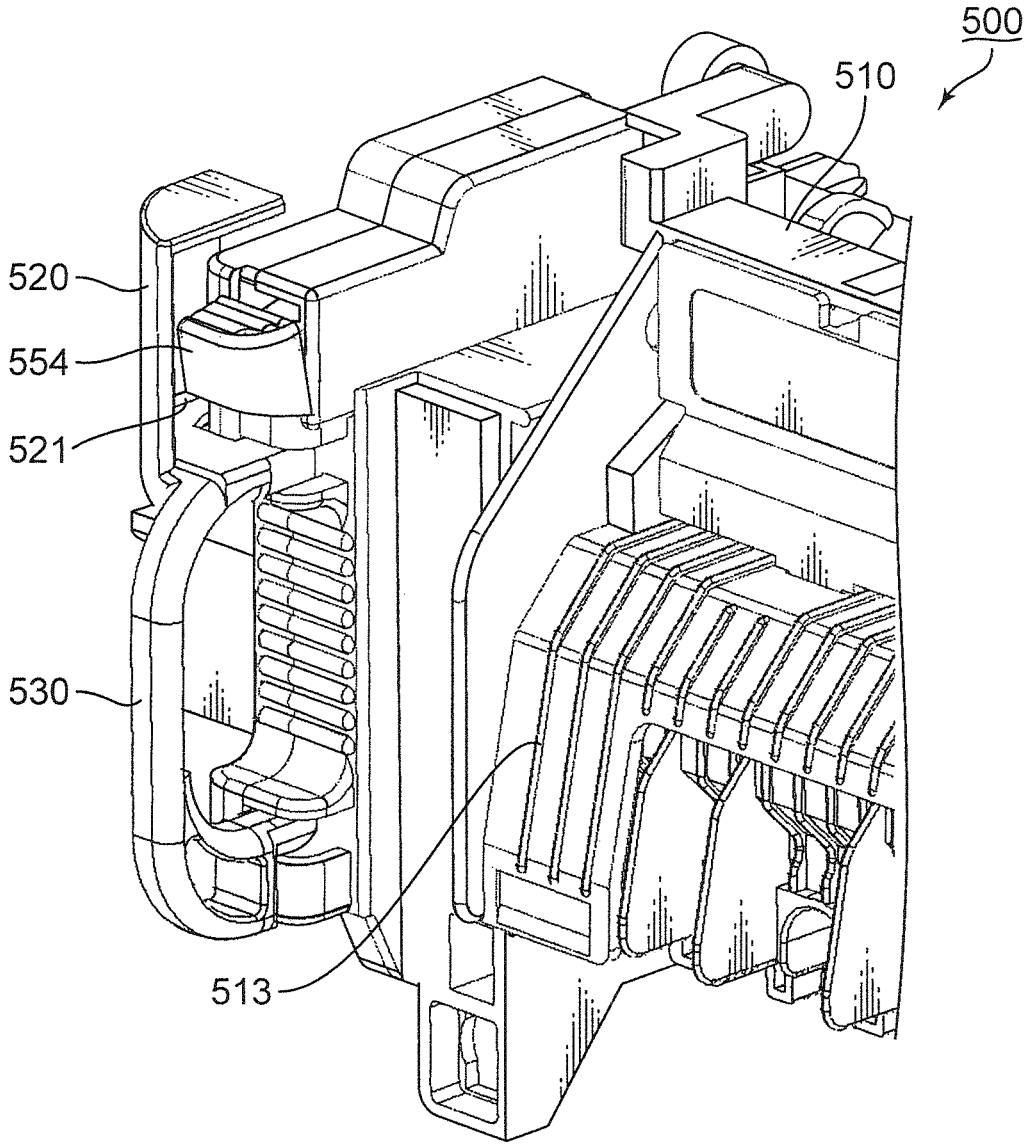
FIG. 9 is a perspective view showing a position of the holding portion, in the case where the rib and the operation portion interfere with each other.

To summarize the above, as shown in FIG. 9, abutment of the rib 521 against the operation portion 554 prevents the cover 520 and the holding portion 530 from pivotally moving about the axis of the pivot shaft 531. This prevents the cover 520 from covering the operation portion 554, and keeps the holding portion 530 at such a position that the holding portion 530 projects from the front plate 513 of the fixing housing 510. Accordingly, the user is allowed to promptly recognize that the fixing housing 510 is in an incompletely mounted state, in other words, is in an unlocked state. Thereafter, when the user mounts the fixing housing 510 at a predetermined position by e.g. re-mounting, and the locking lever 550 is brought to the locking posture, the aforementioned interference state is released, and the cover 520 is returned to the covering position. Further, the holding portion 530 is set flush with the front plate 513.

As described above, according to the embodiment, as far as the locking lever 550 is normally set to the locking posture, the operation portion 554 of the locking lever 550 is accommodated in the accommodation space S divided by the rib 521. On the other hand, when the locking lever 550 is kept in the releasing posture, the rib 521 interferes with the operation portion 554. Accordingly, it is impossible to position the cover 520 at the covering position in a state that the fixing housing 510 is not locked by the locking lever 550. Thus, the user is allowed to promptly recognize that the fixing housing 510 is in an unlocked state.

Figure 10:
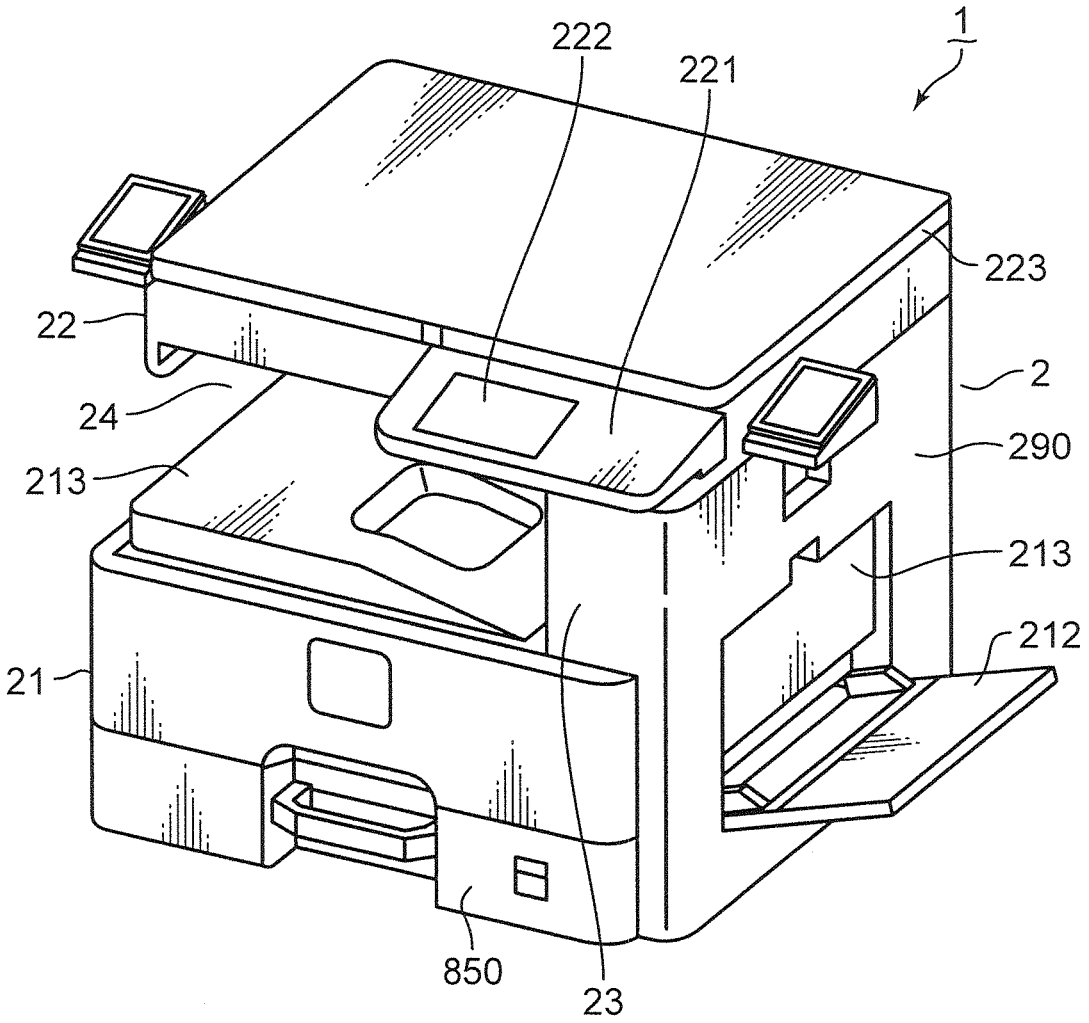
FIG. 10 is a schematic perspective view of an image forming apparatus incorporated with the fixing device.
Figure 11:
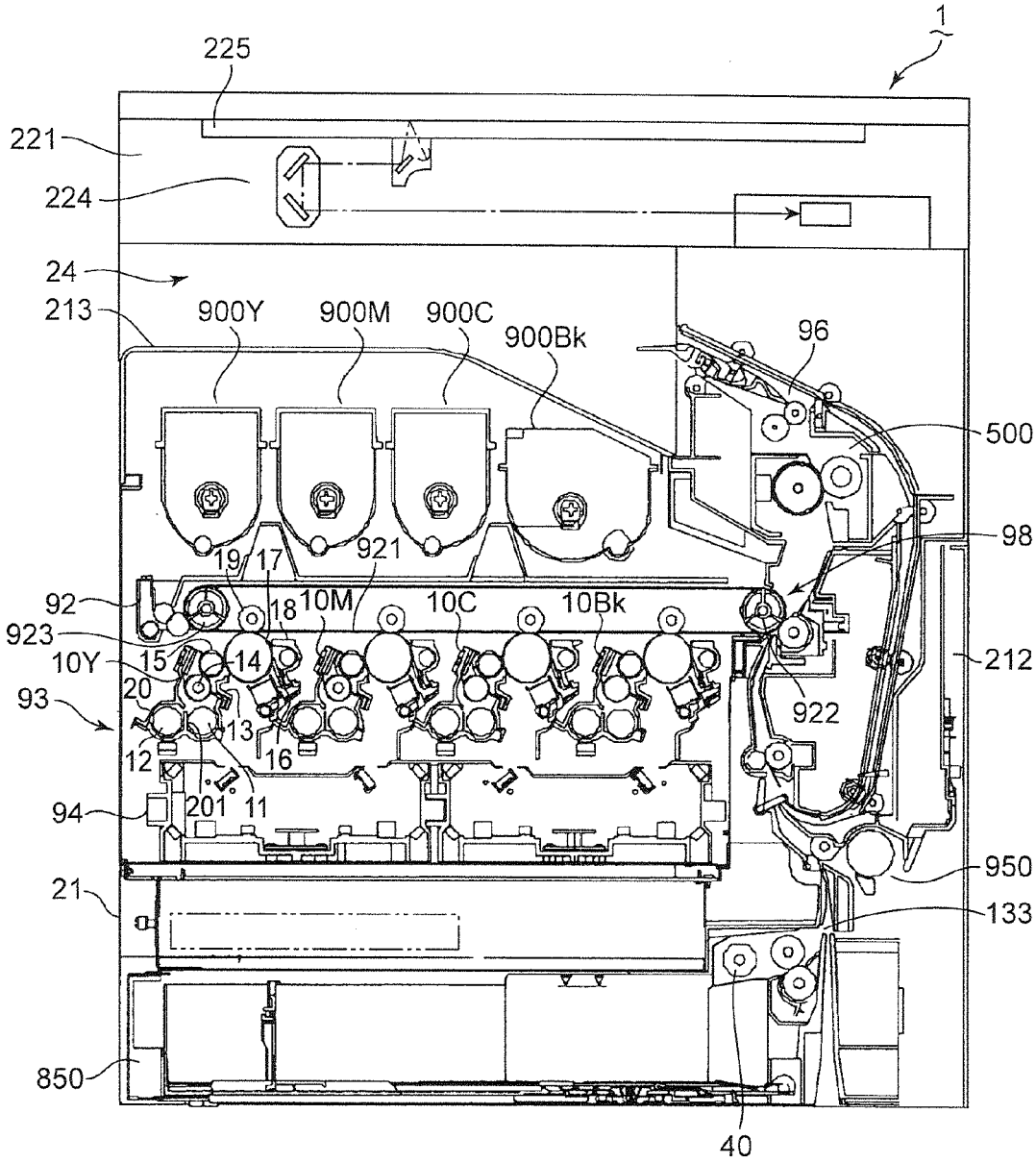
FIG. 11 is a schematic diagram showing an internal structure of the image forming apparatus.

Next, the image forming apparatus 1 incorporated with the fixing device 500 is described. FIG. 10 is a schematic perspective view of the image forming apparatus 1, and FIG. 11 is a schematic diagram showing an internal structure of the image forming apparatus 1. The image forming apparatus 1 shown in FIG. 10 and FIG. 11 is a copier provided with a so-called internal discharge tray. In other embodiment, the image forming apparatus 1 may be a printer, a facsimile machine, a complex machine equipped with the functions of these devices, or other device for forming a toner image on a sheet.

The image forming apparatus 1 includes the substantially rectangular parallelepiped-shaped housing body 2. The housing body 2 includes a substantially rectangular parallelepiped-shaped lower housing part 21, a substantially rectangular parallelepiped-shaped upper housing part 22 disposed above the lower housing part 21, and a connection housing part 23 for connecting between the lower housing part 21 and the upper housing part 22. The connection housing part 23 extends along a right edge and a back surface edge of the housing body 2. A sheet applied with printing thereon is discharged into a discharge space 24 surrounded by the lower housing part 21, the upper housing part 22 and the connection housing part 23.

An operation panel 221 projecting in a front direction of the upper housing part 22 includes an LCD touch panel 222. The operation panel 221 receives an input of information relating to an image forming processing. The user is allowed to input e.g. the number of sheets to be printed or a printing density through the LCD touch panel 222. An electronic circuit for controlling overall control of the image forming apparatus 1 and a device for mainly reading a document image are housed in the upper housing part 22.

A pressing cover 223 disposed above the upper housing part 22 is used for pressing a document. The pressing cover 223 is mounted on the upper housing body 22 to be pivotally movable in up and down directions. The user is allowed to pivotally move the pressing cover 223 upwardly, and place a document on the upper housing part 22. Thereafter, the user is allowed to cause the device disposed in the upper housing part 22 to read the image of the document by manipulating the operation panel 221.

A sheet cassette 850 for accommodating a stack of sheets is housed in the lower housing part 21. The sheet cassette 850 is detachable from the lower housing part 21 in a front direction. Further, a manual tray 212 is mounted on a right wall of the lower housing part 21 to be pivotally movable. When the manual tray 212 is set at such a position as to project in a right direction of the lower housing part 21, the user is allowed to place a sheet or sheets on the manual tray 212. A sheet accommodated in the sheet cassette 850 or a sheet placed on the manual tray 212 is subjected to an image forming processing in the lower housing part 21, based on an instruction inputted by the user through the operation panel 221, and is discharged into the discharge space 24.

The upper housing part 22 houses therein a scanning mechanism 224. The user is allowed to cause the image forming apparatus 1 to read an image of an intended document by the scanning mechanism 224. A contact glass 225 mounted on a top surface of the upper housing part 22 is disposed above the scanning mechanism 224. The pressing cover 223 is used for pressing a document placed on the contact glass 225. When the user manipulates the image forming apparatus 1 through the operation panel 221, the scanning mechanism 224 scans an image on the document placed on the contact glass 225 for reading the image. Analog data information of the image read by the scanning mechanism 224 is converted into a digital signal. The image forming apparatus 1 is operable to form an image on a sheet based on the digital signal.

The lower housing part 21 houses therein various devices for forming an image on a sheet. Further, the connection housing part 23 houses therein various devices for discharging a sheet subjected to an image forming processing into the discharge space 24. The lower housing part 21 houses therein toner containers 900Y, 900M, 900C, 900Bk, an intermediate transfer unit 92, an image forming assembly 93, an exposure unit 94, the fixing device 500, and a discharge unit 96.

The image forming assembly 93 includes the yellow toner container 900Y, the magenta toner container 900M, the cyan toner container 900C and the black toner container 900Bk. Developing devices 10Y, 10M, 10C and 10Bk respectively corresponding to the colors of yellow (Y), magenta (M), cyan (C) and black (Bk) are disposed below the respective corresponding containers 900Y, 900M, 900C and 900Bk. The image forming assembly 93 forms an image on a sheet, using the toners accommodated in the toner containers 900Y, 900M, 900C and 900Bk.

The image forming assembly 93 includes photosensitive drums 17 (photosensitive members on which electrostatic latent images are formed by electrophotography) for carrying toner images of the respective colors thereon. A photosensitive drum using an amorphous silicon (a-Si)-based material may be used as each respective photosensitive drum 17.

A charger 16, a developing device 10 (10Y, 10M, 10C and 10Bk), a transfer roller 19 and a cleaning device 18 are disposed around each of the photosensitive drums 17. Each respective charger 16 uniformly charges the surface of the corresponding photosensitive drum 17. The surface of the photosensitive drum 17 after the charging is exposed to light by the exposure unit 94 for forming an electrostatic latent image. The exposure unit 94 irradiates the circumferential surface of the each respective photosensitive drum 17 with laser light, based on a digital signal generated by the scanning mechanism 224 as described above. The developing devices 10Y, 10M, 10C and 10Bk respectively develop the electrostatic latent images formed on the photosensitive drums 17 into toner images of the respective colors, using the color toners to be supplied from the toner containers 900Y, 900M, 900C and 900Bk. Each respective transfer roller 19 forms a nip portion with the corresponding photosensitive drum 17, with an intermediate transfer belt 921 being interposed between the photosensitive drum 17 and the transfer roller 19, and transfers the toner image on the photosensitive drum 17 onto the intermediate transfer belt 921 (primary transfer). Each respective cleaning device 18 cleans the circumferential surface of the corresponding photosensitive drum 17 after the toner image transfers.

Each of the developing devices 10Y, 10M, 10C and 10Bk is provided with a developing housing body 20. A two-component developer composed of magnetic carrier and toner is housed in the each respective developing housing body 20. Further, agitation rollers 11 and 12 are rotatably disposed side by side in the each respective developing housing body 20 in a state that axial directions of the agitation rollers 11 and 12 are aligned in parallel to the longitudinal direction of the developing housing body 20, at a position near a bottom portion of the developing housing body 20.

A circulation path for the developer is formed in an inner bottom surface of the developing housing body 20. The agitation rollers 11 and 12 are disposed in the circulation path. A partition wall 201 standing upright from the bottom portion of the developing housing body 20 extends in the axial direction of the agitation rollers 11 and 12, at a position between the agitation rollers 11 and 12. The partition wall 201 divides the circulation path. The circulation path is formed in such a manner as to circulate around the partition wall 201. The two-component developer is charged, while being agitated and transported along the circulation path by the agitation rollers 11 and 12.

The two-component developer is circulated in the developing housing body 20 while being agitated by the agitation rollers 11 and 12 for charging the toner. The two-component developer on the agitation roller 11 is carried while being magnetically attracted by a magnetic roller 14 disposed above the agitation roller 11. The magnetically attracted two-component developer forms a magnetic brush (not shown) on the magnetic roller 14. The magnetic brush has its layer thickness restricted by a doctor blade 13. A toner layer on a developing roller 15 is formed by a potential difference between the magnetic roller 14 and the developing roller 15. An electrostatic latent image on the photosensitive drum 17 is developed into a toner image, using the toner layer.

The exposure unit 94 has various optical devices such as a light source, a polygon mirror, a reflection mirror and a deflection mirror. The exposure unit 94 irradiates light onto the circumferential surface of the each respective photosensitive drum disposed at an appropriate position in the image forming assembly 93, based on image data, for forming an electrostatic latent image.

The intermediate transfer unit 92 is provided with the intermediate transfer belt 921, a driving roller 922 and a driven roller 923. Toner images are formed one over the other from the respective corresponding photosensitive drums 17 onto the intermediate transfer belt 921 (primary transfer). The superimposed toner images formed by the primary transfer are transferred onto a sheet to be supplied from the sheet cassette 850 or from the manual tray 212 in a secondary transfer portion 98 (secondary transfer). The driving roller 922 and the driven roller 923 for circulating and driving the intermediate transfer belt 921 are rotatably supported by the lower housing part 21.

The fixing device 500 applies a fixing processing to the sheet with toner images thereon, which have been transferred from the intermediate transfer unit 92 by the secondary transfer. The sheet carrying the color image after the fixing processing is fed toward the discharge unit 96 defined at an upper position (in the connection housing body 23) of the fixing device 500.

The discharge unit 96 discharges the sheet transported from the fixing device 500 to a top surface 213 of the lower housing part 21, serving as a discharge tray.

The sheet cassette 850 accommodates a stack of sheets for image formation. As described above, the sheet cassette 850 is detachably attached to the lower housing part 21. By driving a pickup roller 40 disposed in the sheet cassette 850, the sheets in the sheet cassette 850 are dispensed one by one from the uppermost sheet of the sheet stack to a sheet transport path 133, and then guided to the image forming assembly 93. The pickup roller 40, the sheet transport path 133 and roller elements disposed at predetermined positions in the sheet transport path 133 serve as a transport portion for transporting a sheet to the image forming assembly 93 for forming an image on the sheet.

The manual tray 212 is disposed above the sheet cassette 850. A sheet feeding structural member 950 is disposed near a lower end of the manual tray 212. The sheet feeding structural member 950 feeds the sheets placed on the manual tray 212 to the image forming assembly 93 one by one for forming an image on the sheets in the image forming assembly 93.

Figure 12:
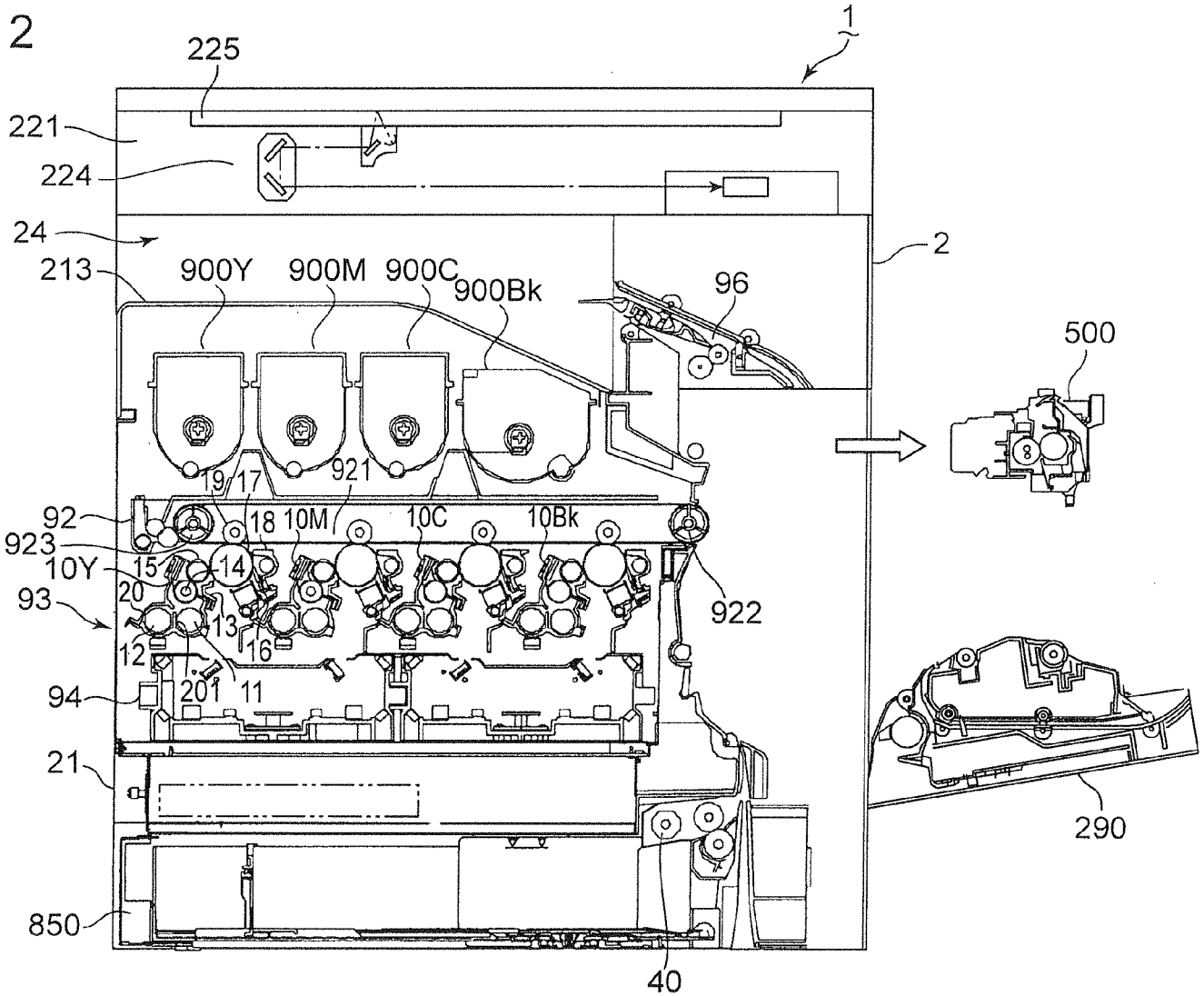
FIG. 12 is a diagram for describing a manner as to how the fixing device is detached from the image forming apparatus.

FIG. 12 is a cross-sectional view schematically showing the fixing device 500 which is detached from the housing body 2 of the image forming apparatus 1. By pivotally moving a side cover 290 of the housing body 2 shown in FIG. 10, the user is allowed to attach or detach the fixing device 500 to or from the housing body 2. As described above, the user is allowed to pivotally move the holding portion 530 to expose the operation portion 554, and then is allowed to depress the operation portion 554. As a result of the above operation, the engagement between the support plate 600 formed in the housing body 2 and the fixing device 500 is released. Thereafter, the user is allowed to detach the fixing device 500 from the housing body 2, while holding the holding portion 530.

Conversely to the above, the user is allowed to hold the holding portion 530 of the fixing device 500 and engage the support plate 600 formed in the housing body 2 in the slit 511 of the fixing housing 510 for attaching the fixing device 500 to the housing body 2. As a result of the above operation, the hook 552 urged by the coil spring 556 is engaged in the engagement hole 610 formed in the support plate 600, and the position of the fixing device 500 is locked in the housing body 2. Thereafter, when the user releases his or her hand from the holding portion 530, the cover 520 is automatically returned to the covering position by the action of the torsion coil springs 532. As a result of the above operation, the cover 520 covers the operation portion 554.

As described above, according to the embodiment, the user is allowed to lock and release the fixing housing 510 (a processing housing) to and from the housing body 2 by manipulating the locking lever 550. Further, since the locking lever 550 is covered by the cover 520 in the covering position, there is no likelihood that the user may inadvertently touch the locking lever 550. The user is allowed to manipulate the locking lever 500 by shifting the cover 520 to the opening position while holding the holding portion 530, in releasing the locking of the fixing housing 510 by the locking lever 550. Further, when the locking lever 550 is in the releasing posture, the rib 521 interferes with the locking lever 550. Accordingly, the user is allowed to promptly recognize that the locking of the fixing housing 510 at the predetermined position is insufficient.

Thus, the embodiment is advantageous in preventing the user from inadvertently manipulating the locking lever 550, and in facilitating the user to recognize an incomplete mounting of the fixing housing 510. Accordingly, there is no or less likelihood that the fixing housing 510 may be kept in an incompletely mounted state.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A processing structural member, comprising:

a processing housing which supports a processing portion for performing a predetermined processing;

a locking lever which is operable to change a posture thereof between a locking posture of locking a position of the processing housing, and a releasing posture of releasing the locking;

a cover which is mounted on the processing housing to be pivotally movable between a covering position of covering the locking lever, and an opening position of exposing the locking lever to be visually recognizable; and a holding portion which is mounted on the processing housing to be pivotally movable with the cover, wherein the cover has an interference member which is inoperable to interfere with the locking lever when the locking lever is in the locking posture, and is operable to interfere with the locking lever when the locking lever is in the releasing posture in shifting the cover from the opening position to the covering position.

2. The processing structural member according to claim 1, wherein the locking lever is a rod-like member, and has a first end, a second end opposite to the first end and a pivot shaft disposed between the first end and the second end, the first end of the locking lever has a hook portion engageable with an engagement portion, and the second end of the locking lever has an operation portion manipulatable by a user in changing the posture of the locking lever, the posture of the locking lever is changed by a pivotal movement of the pivot shaft about an axis of the pivot shaft, and the operation portion is operable to be covered by the cover, and interfere with the interference member when the locking lever is in the releasing posture.

3. The processing structural member according to claim 2, wherein the interference member is a rib formed on a back surface of the cover, an accommodation space divided by the rib being formed beneath the back surface of the cover, when the locking lever is in the locking posture, the operation portion is operable to be received in the accommodation space to thereby shift the cover from the opening position to the covering position, and when the locking lever is in the releasing posture, the rib is operable to interfere with the operation portion to thereby restrict the cover from shifting from the opening position to the covering position.

4. The processing structural member according to claim 1, further comprising:

an urging member which urges the cover in such a direction as to shift the cover from the opening position toward the covering position.

5. The processing structural member according to claim 1, wherein the holding portion is set flush with the processing housing when the cover is in the covering position, and the holding portion projects from the processing housing when the cover is in the opening position.

6. The processing structural member according to claim 1, wherein the cover is made of a non-transparent material.

7. An image forming apparatus, comprising:

a housing body;

an image forming portion which forms an image on a sheet using toner;

a fixing portion which fixes the toner on the sheet;

a fixing housing which supports the fixing portion;

a locking lever which is operable to change a posture thereof between a locking posture of locking a position of the fixing housing in the housing body, and a releasing posture of releasing the locking;

a cover which is mounted on the fixing housing to be pivotally movable between a covering position of covering the locking lever, and an opening position of exposing the locking lever to be visually recognizable; and a holding portion which is mounted on the fixing housing to be pivotally movable with the cover, wherein the cover has an interference member which is inoperable to interfere with the locking lever when the locking lever is in the locking posture, and is operable to interfere with the locking lever when the locking lever is in the releasing posture in shifting the cover from the opening position to the covering position.

8. The image forming apparatus according to claim 7, wherein the locking lever is a rod-like member, and has a first end, a second end opposite to the first end and a pivot shaft disposed between the first end and the second end, the first end of the locking lever has a hook portion engageable with an engagement portion, and the second end of the locking lever has an operation portion manipulatable by a user in changing the posture of the locking lever, the posture of the locking lever is changed by a pivotal movement of the pivot shaft about an axis of the pivot shaft, and the operation portion is operable to be covered by the cover, and interfere with the interference member when the locking lever is in the releasing posture.

9. The image forming apparatus according to claim 8, wherein the interference member is a rib formed on a back surface of the cover, an accommodation space divided by the rib being formed beneath the back surface of the cover, when the locking lever is in the locking posture, the operation portion is operable to be received in the accommodation space to thereby allow the cover to shift from the opening position to the covering position, and when the locking lever is in the releasing posture, the rib is operable to interfere with the operation portion to thereby prevent the cover from shifting from the opening position to the covering position.

10. The image forming apparatus according to claim 7, further comprising:

an urging member which urges the cover in such a direction as to direct the cover from the opening position toward the covering position.

11. The image forming apparatus according to claim 7, wherein the holding portion is set flush with the fixing housing when the cover is in the covering position, and the holding portion projects from the fixing housing when the cover is in the opening position.

12. The image forming apparatus according to claim 7, wherein the cover is made of a non-transparent material.

* * * * *